US005953768A

United States Patent [19]

Jarosz et al.

[11] Patent Number: 5,953,768

[45] Date of Patent: Sep. 21, 1999

[54] APPARATUS FOR USE WHEN WASHING HAIR

[76] Inventors: Thomas J. Jarosz, 2402 N. 82nd St., Wauwatosa, Wis. 53213; James P. Mazzulla, 9077 N. Greenbrook Ct., River Hills, Wis. 53217; Frank L. Donnelly, 99 Pine Valley Rd., Dover, Del. 19904

[21] Appl. No.: 08/999,862

[22] Filed: Sep. 22, 1997

Related U.S. Application Data

[63] Continuation-in-part of application No. 08/660,844, Jun. 10, 1996, abandoned.

[51] Int. Cl.[6] ..... A45D 44/08

[52] U.S. Cl. ..... 4/522; 4/520

[58] Field of Search ..... 4/515, 520, 521, 4/522

[56] References Cited

U.S. PATENT DOCUMENTS

| | | | |
|---|---|---|---|
| 367,157 | 7/1887 | Norvotnick | 4/522 |
| 1,806,155 | 5/1931 | Farrelly | 4/521 |
| 2,112,669 | 3/1938 | Halas | 4/522 X |
| 2,281,832 | 5/1942 | Cravotta | 4/520 X |
| 2,453,784 | 11/1948 | Conjurske | 4/522 |
| 5,146,629 | 9/1992 | Barnes | 4/521 X |

*Primary Examiner*—Robert M. Fetsuga

*Attorney, Agent, or Firm*—Jansson, Shupe, Bridge & Munger, Ltd.

[57] ABSTRACT

An apparatus for use when washing a person's hair includes a liquid catch member having an inward, head-surrounding portion with an opening for receiving a person's head. A ring-like support member is spaced outwardly from such portion. In the improvement, the catch member is fully flaccid, i.e., free of reinforcement or auxiliary support devices, between the portion and the support member. And the catch member has a tunnel-like passage receiving the support member therealong. The cross-sectional area of the passage is greater than that of the support member so that the latter can be readily threaded into and removed from the catch member. In more-specific embodiments, the head-surrounding portion includes a drawstring or elastic band, to fit all head sizes, and a disposable "one-time-use," person-contacting strip. A new method is also disclosed.

9 Claims, 8 Drawing Sheets

FIG.17
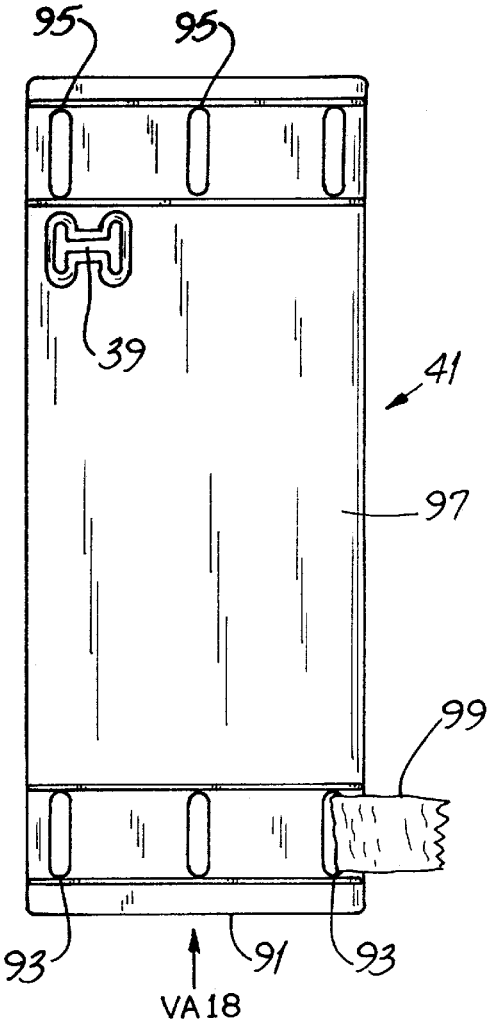
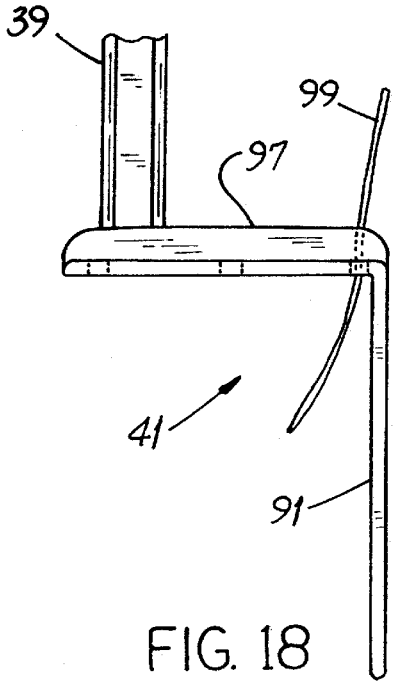
FIG. 18
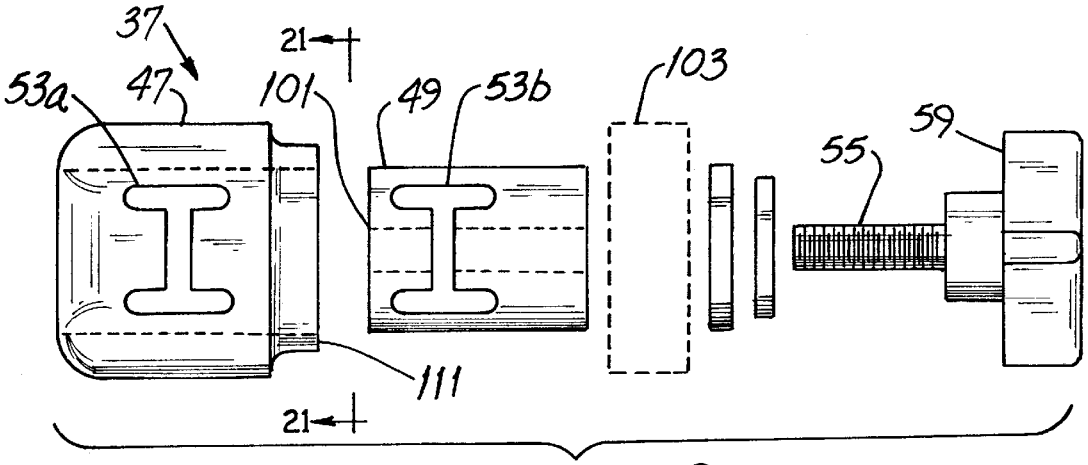
FIG. 20

APPARATUS FOR USE WHEN WASHING HAIR

RELATED APPLICATION

This application is a continuation-in-part of application Ser. No. 08/660,844 filed on Jun. 10, 1996, and now abandoned.

FIELD OF THE INVENTION

This invention is related generally to baths, closets and sinks and, more particularly, to body-supported hair-washing devices.

BACKGROUND OF THE INVENTION

In beauty salons and the like, it is common to wash a person's hair prior to styling, setting or applying color tinting. And hair washing is regularly provided in hospitals and nursing homes. Typically, the person is requested to lie supine or semi-supine in a backwardly-reclining chair with the head resting upon a curved recess formed in the edge of the wash basin. Wash water flows from the person's head and hair directly into the basin.

There is a growing awareness that washing hair in this way can induce what has come to be known as "beauty parlor stroke syndrome." There have been instances of cervical musculoskeletal and vascular damage, e.g., vertebral carotid artery damage and resultant neurological sequelae, when the person's neck is hyperextended over a sink or basin. Damage to the blood vessels in the neck can result in transient ischemic attacks and cerebral vascular accidents. And the hyperextension of the neck results in musculoskeletal pain and discomfort.

Devices have been configured for use when washing a person's hair while the person is seated in an upright position. For example, U.S. Pat. Nos. 367,157 (Norvotnick) and 717,148 (Walters) disclose such devices but there is no suggestion that the inventors recognized the possibility of beauty parlor stroke syndrome or that such devices were configured to address such syndrome. On the contrary. The Walters patent explains that the hood is to protect the face and clothing while the person remains in what the patent calls a normal position.

The Norvotnick device includes a funnel-shaped vessel made of india rubber. Clearly, the vessel retains a shape, i.e., is not flaccid or limp, and, apparently, is used by stretching it over the head of the person.

The Walters hood includes a rubber sheet permanently attached to a reinforcing wire which extends inwardly to engage the head and bend around the ears. Of course, wire does not stretch so it is unclear as to how the Walters hood is fitted to persons' heads of varying size.

It is apparent that the Walters hood has some shape-retention capability—portions of the sheet are reinforced with wire as described above and with an extra layer of rubber. And the entire sheet is understood to be secured to the head with two pairs of buttoning rubber straps. A separate curved metal trough plate supports the sheet so that water drains into a receptacle.

While these prior art devices were presumably suitable for their intended purpose, they are not without disadvantages. For example, both the Norvotnick and the Walters devices are intended to stretch over the head of the person. If the head-engaging portion of the device is sized for a small person, it is likely to be quite uncomfortable when stretched over the head of a large person. And, conversely, if sized for a large person, it seems unlikely that the device will fit a small person satisfactorily.

Another apparent disadvantage is being less than fully flaccid, the vessel (Norvotnick) or hood (Walters) may be unnecessarily difficult to pack and store. And the Walters hood includes a rigid trough which could be cumbersome in use and, more certainly, in storage.

Yet another disadvantage relates to sanitation in use. Neither the Norvotnick nor the Walters patents disclose any recognition of a need to provide a feature making the device "user-specific" or how to do so.

Still other disadvantages relate to cleansing of the device and to positioning of the vessel or hood with respect to the supporting structure. Both the Norvotnick vessel and the Walters hood include a wire, reinforcement or the like which is inseparable from the water-impermeable portion. Cleansing of such portion is seemingly made more difficult. Further, repair by replacement of such portion without discarding the entire supporting structure appears to be impossible as is positional adjustment of the supporting structure and the wire or other reinforcement with respect to one another.

A new apparatus for use when washing hair which addresses certain shortcomings of earlier devices in this field and which aids in preventing beauty parlor stroke syndrome would be an important advance in the art.

OBJECTS OF THE INVENTION

It is an object of this invention to provide a new apparatus for use when washing hair which overcomes some of the problems and shortcomings of devices of the prior art.

Another object of this invention is to provide such an apparatus which helps prevent beauty parlor stroke syndrome.

Another object of this invention is to provide such an apparatus which is easy to pack and store.

Another object of this invention is to provide such an apparatus which facilitates sanitation in use.

Still another object of this invention is to provide such an apparatus which is easy to cleanse after use.

Another object of this invention is to provide such an apparatus which is easily repaired.

Yet another object of this invention is to provide such an apparatus in which the water-catching portion and the support member are readily, positionally adjustable with respect to one another. How these and other objects are accomplished by the invention will become apparent from the following descriptions and from the drawings.

SUMMARY OF THE INVENTION

The invention is an improvement in an apparatus for use when washing hair. The apparatus includes a sheet-like liquid catch member having an inward portion defining an opening for receiving a person's head therethrough. A relatively-rigid member supporting the catch member is spaced outwardly from the inward portion.

In the improvement, the catch member is flaccid between the portion and the support member. Using a catch member which is flaccid, rather than reinforced, offers a number of advantages in ease of handling and ease of use.

Most preferably, the catch member is made of highly-flexible, water-impermeable fabric and by means described below, is made to fit snugly around the head of the person whose hair is being washed. Soapy water, coloring solutions and the like are thereby prevented or substantially prevented from running downwardly across the face or down the neck of the person.

In another aspect of the invention, the support member has a first cross-sectional area. The catch member is folded or wrapped around the support member and defines a passage having a second cross-sectional area greater than the first cross-sectional area. Such configuration permits the catch member and the support member to be readily moved with respect to one another. And, more particularly, permits the catch member to be "threaded onto" and removed from the support member.

In a preferred embodiment, the support member comprises a hoop having a separable joint facilitating installation of the catch member to the support member. The passage in the catch member has first and second ends and includes a "cutout" or insertion notch between the ends, thereby permitting the catch member to be readily removed from and mounted to the support member.

In a more specific embodiment, the catch member includes an apron portion extending away from the opening. Such opening is between the notch and the apron portion. Even more specifically, the notch and the apron are at opposed positions so that the notch is at the most-elevated location on the apparatus to prevent water from running through the notch.

In yet another aspect of the invention, the opening includes a tunnel around it and a securing device extends along the tunnel. Such securing device may be a drawstring with a stop or may be an elastic band. The former permits engaging the catch member to the head with equal force, irrespective of the size of the person's head. And the latter may be found to be more convenient in use.

The new apparatus also includes a novel support rod and related adjustment device. A bracket-like attachment mechanism is provided to couple the apparatus to a chair back or the like. Extending upwardly from the attachment mechanism is an elongate support rod.

The support member includes an adjustment device attached to it and the rod extends through an aperture in the device. While the rod and the aperture may be circular, the rod and the aperture are, in a preferred embodiment, formed to a torque-transmitting shape.

In yet another aspect of the invention, the opening includes an inward boundary surface and a releasable strip adheres to such boundary surface. The strip is disposable, suitable for "one-time use," and is preferred for sanitary reasons. A highly preferred strip is comprised of a thin, sponge-like resilient material which absorbs water and which has an adhesive coating along one surface.

The invention also involves a new method for washing a person's hair while retaining the neck of the person in a neutral position, i.e., substantially vertical position. The method includes providing an apparatus having a flaccid liquid catch member with an inward portion defining an opening for receiving a person's head therethrough and a support member spaced outwardly from such portion and having an inward boundary surface.

A releasable strip is applied to the boundary surface and the inward portion and releasable strip are fitted about the head of the person whose hair is being washed. After hair washing is completed and the hair "toweled" damp dry, the inward portion is removed from the head. Then the releasable strip is removed and discarded.

A more specific aspect of the method includes positioning the support member at a location along the rod and securing the adjustment device. The support member is thereby positionally affixed with respect to the rod.

Other details of the invention are set forth in the following detailed description and in the drawings.

BRIEF DESCRIPTION OF THE DRAWINGS

FIG. 17 is a top plan view of another embodiment of the attachment mechanism of the apparatus. Parts are broken away.

FIG. 18 is an elevation view of the attachment mechanism of FIG. 17 taken along the viewing axis VA18 thereof. Parts are broken away.

FIG. 20 is an exploded view of another embodiment of the adjustment mechanism shown in conjunction with, in dashed outline, the portion shown in FIG. 19. Hidden surfaces of parts are in dashed line.

DETAILED DESCRIPTIONS OF THE PREFERRED EMBODIMENTS

Figure 1:
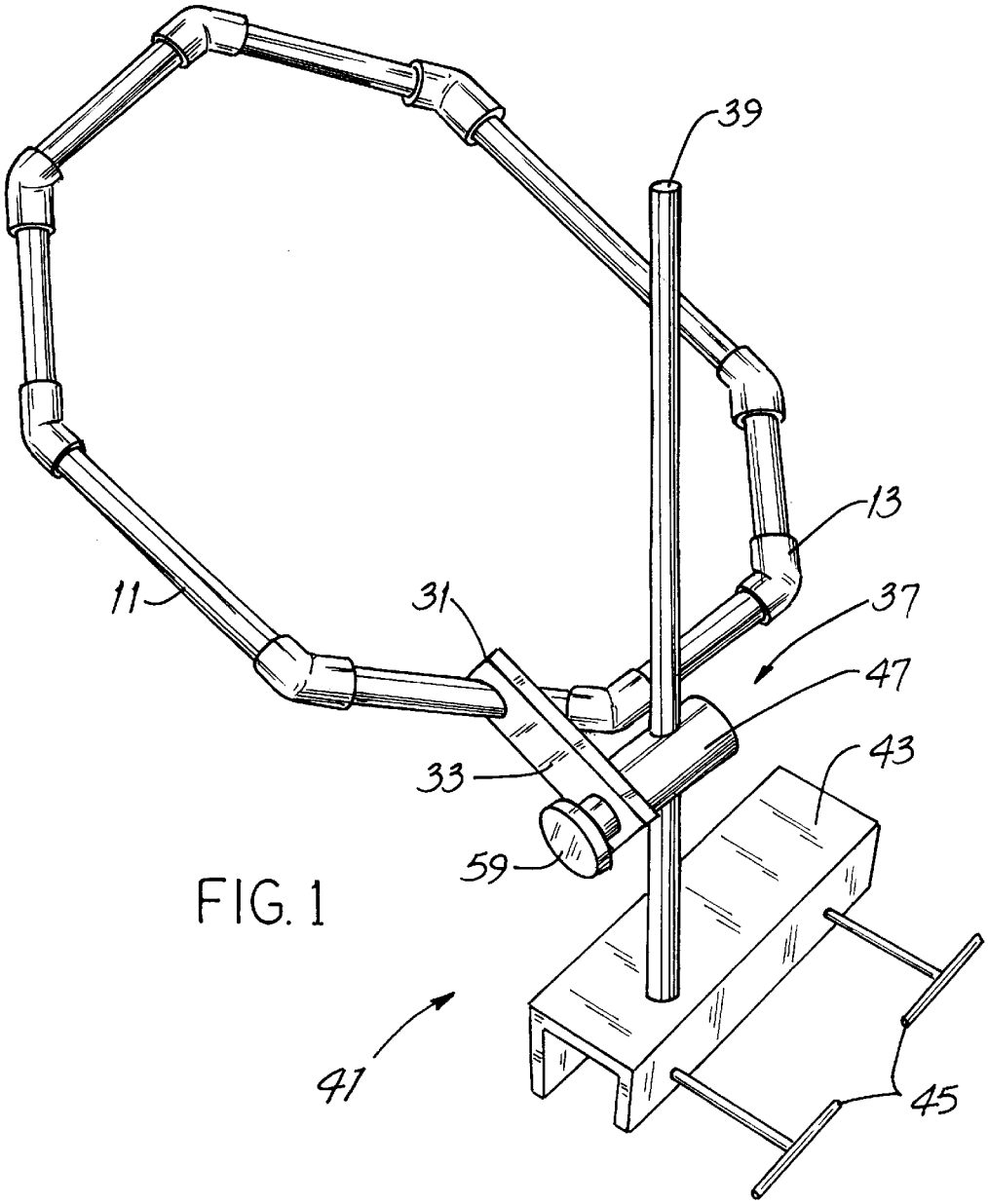
FIG. 1 is a perspective view of components of a first embodiment of the new apparatus.

Referring to FIGS. 1 through 10, a first embodiment of the new apparatus 10 includes a rigid hoop or support member 11 made of hollow tubing or the like. Preferably, one of the joints 13 in the member 11 can be opened to permit threading such member 11 into a passage 15 in the liquid catch member 17 shown in FIGS. 2, 3 and 10. The passage 15 in the catch member 17 has first and second ends 19 and 21 includes a "cutout" or insertion notch 23 between the ends 19, 21, thereby permitting the catch member 17 to be readily mounted to and removed from the support member 11. The notch 23 is between the opening 25 and the apron portion 27.

Figure 2:
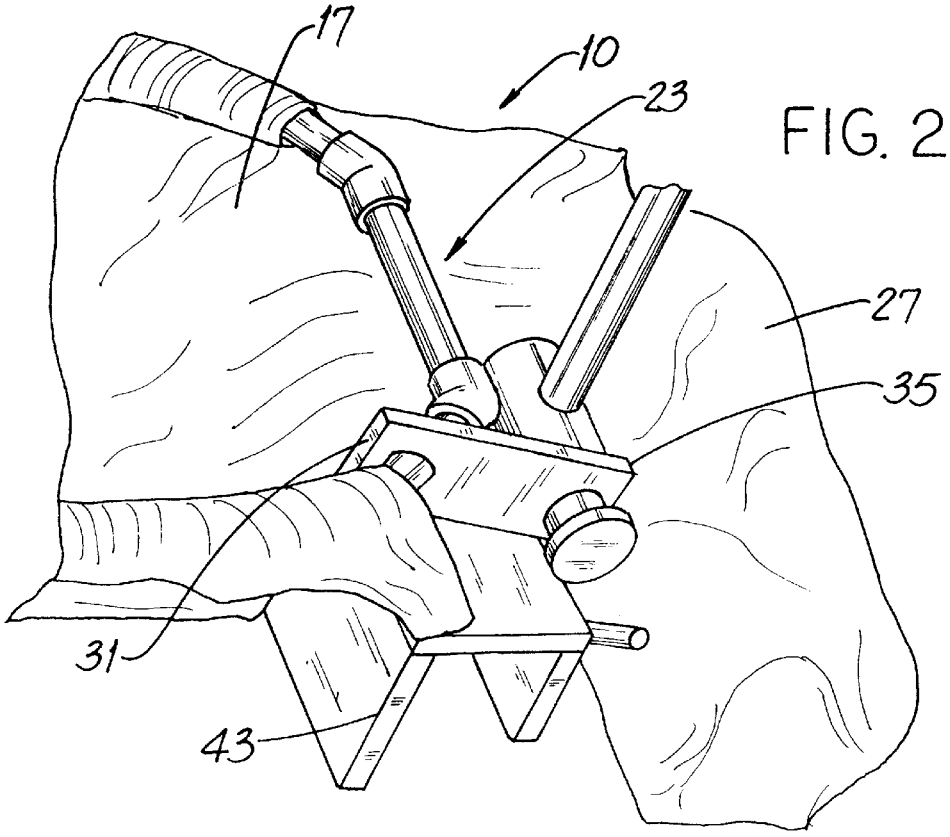
FIG. 2 is perspective view of components shown in FIG. 1 and further showing the apparatus catch member mounted on the apparatus support member. Parts are broken away.
Figure 3:
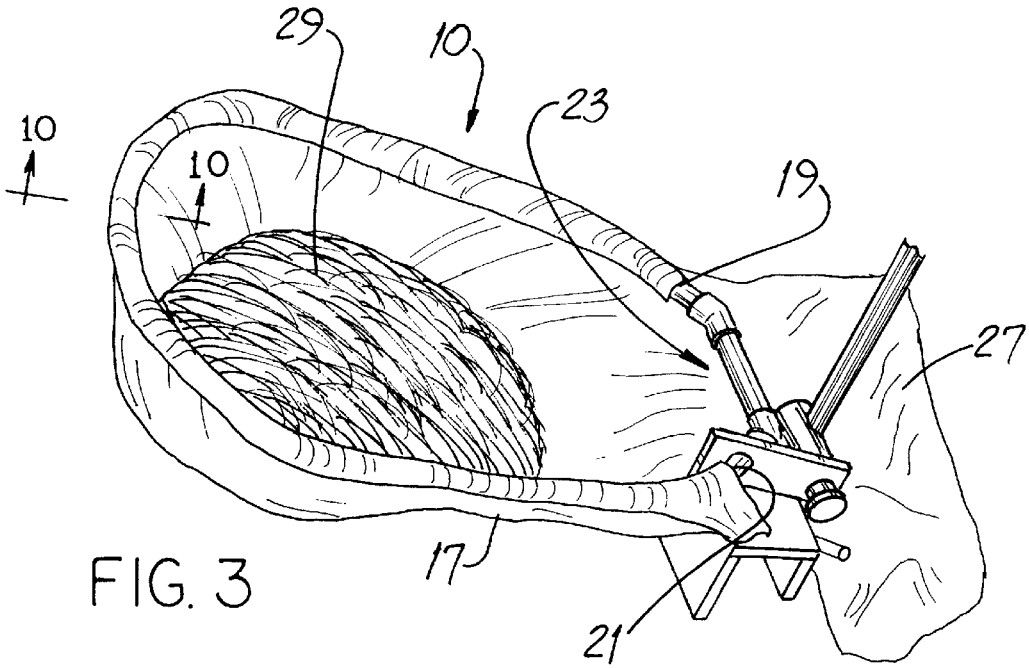
FIG. 3 is another perspective view generally like that of FIG. 2 and further showing the relationship of the apparatus to the head of a person whose hair is being washed. Parts are broken away.
Figure 4:
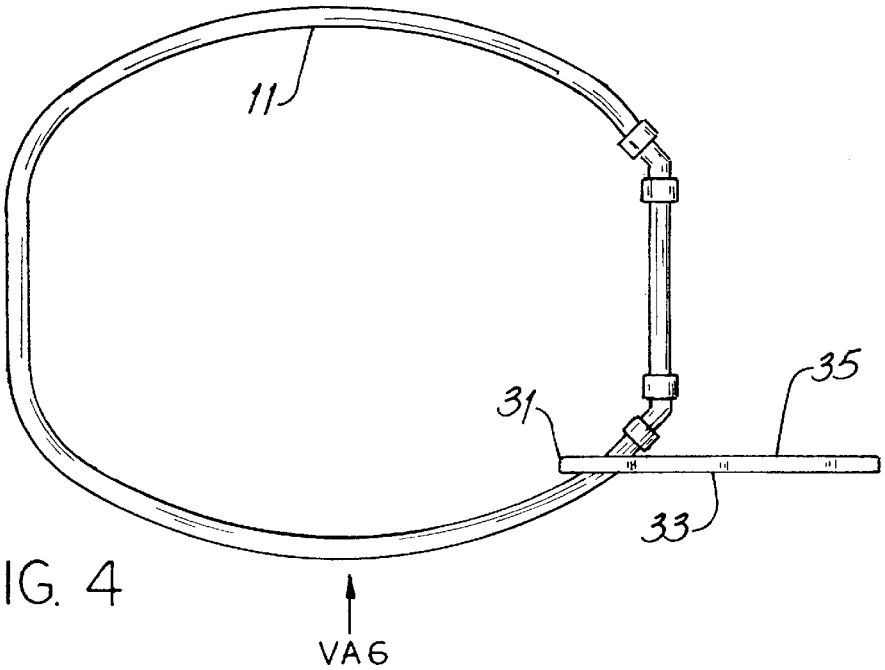
FIG. 4 is a top plan view of another embodiment of the support member of the apparatus.
Figure 5:
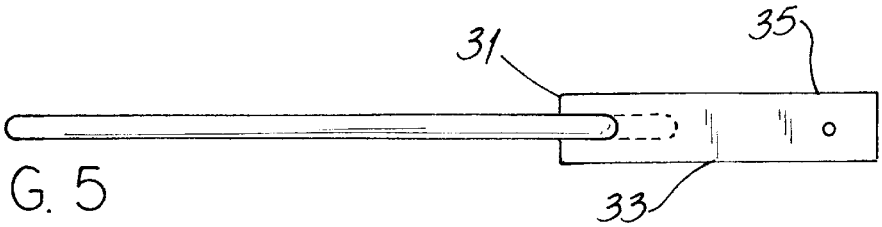
FIG. 5 is an elevation view of the support member of FIG. 4 taken along the viewing axis VA5 thereof. Surfaces of parts are shown in dashed line.
Figure 10:
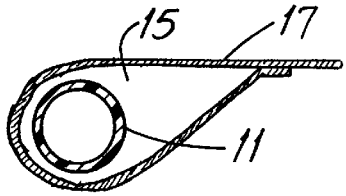
FIG. 10 is a section view taken along the viewing plane 10—10 of FIG. 3.

Referring particularly to FIGS. 2, 3 and 10, the support member 11 has a first cross-sectional area. The catch member 17 is folded or wrapped around the support member 11 (and secured by sewing, gluing, hook-and-eye fasteners or the like) and the passage 15 has a second cross-sectional area greater than the first cross-sectional area. Such configuration permits the catch member 17 and the support member 11 to be readily moved with respect to one another.

Apron portion 27 extends rearwardly from the opening 25 which receives the head of the person whose hair 29 is being washed. Such apron portion 27 may be draped over the edge of a wash basin to flow wash and rinse water from the head into such basin.

The support member 11 is rigidly coupled to one end 31 of an elongate plate 33, the other end 35 of which is coupled by an adjustment device 37 to a support rod 39 extending upwardly from an attachment mechanism 41. The mechanism 41 includes an inverted U-shaped bracket 43 sized to fit over the back of a chair or the like. The bracket 43 is secured to the chair using a pair of hand-rotated screws 45.

Figure 9:
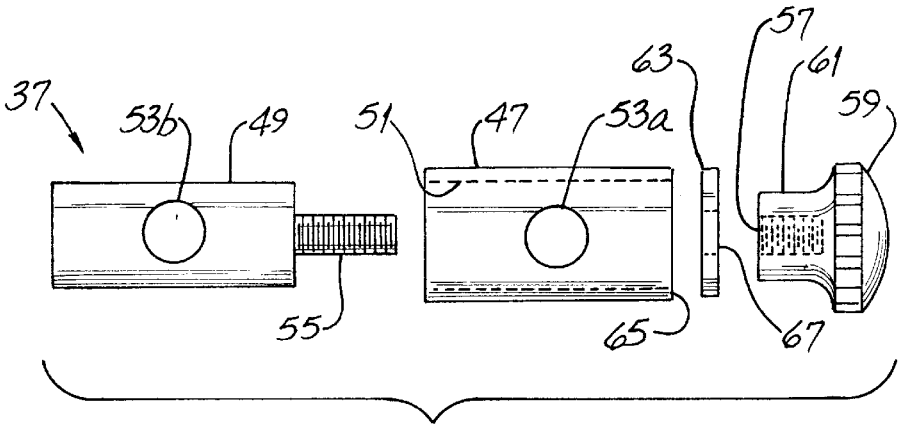
FIG. 9 is an exploded view of a first embodiment of a position adjustment device. Hidden surfaces of parts are shown in dashed line.

The adjustment device 37 and the rod 39 cooperate to permit the member 11 to be vertically positioned to accommodate the stature of the person whose hair 29 is being washed. Referring particularly to FIGS. 1 and 9, the adjustment device includes an exterior tube 47 and an inner cylindrical bar 49 slidable along the tube interior wall 51 with slight clearance. The tube 47 and the bar 49 include respective apertures 53*a*, 53*b* sized to receive the rod 39 therethrough with sliding clearance.

The bar 49 includes a threaded shank 55 which engages a threaded hole 57 in the adjustment knob 59. The knob stem 61 can be sized to have about the same outside diameter as that of the tube 47 or an intervening washer 63 can be used to bear against the tube end 65. If the latter arrangement is used, the washer 63 has a hole 67 therethrough that receives the shank 55 with clearance.

When the knob 59 and shank 55 are threaded away from one another, the apertures 53*a*, 53*b* can be aligned so that the device 37 (with the plate 33, support member 11 and catch member 17 coupled thereto) can be moved along the rod 39 to the proper height. And when such height is attained, the knob 59 is tightened and the bar 49 is displaced axially along the tube 47 so that the apertures 53*a*, 53*b* become somewhat misaligned. The rod 39 is thereby gripped tightly.

Figure 14:
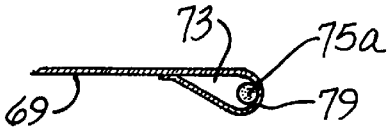
FIG. 14 is a section view taken along the viewing plane 14—14 of FIG. 6. Parts are broken away.
Figure 6:
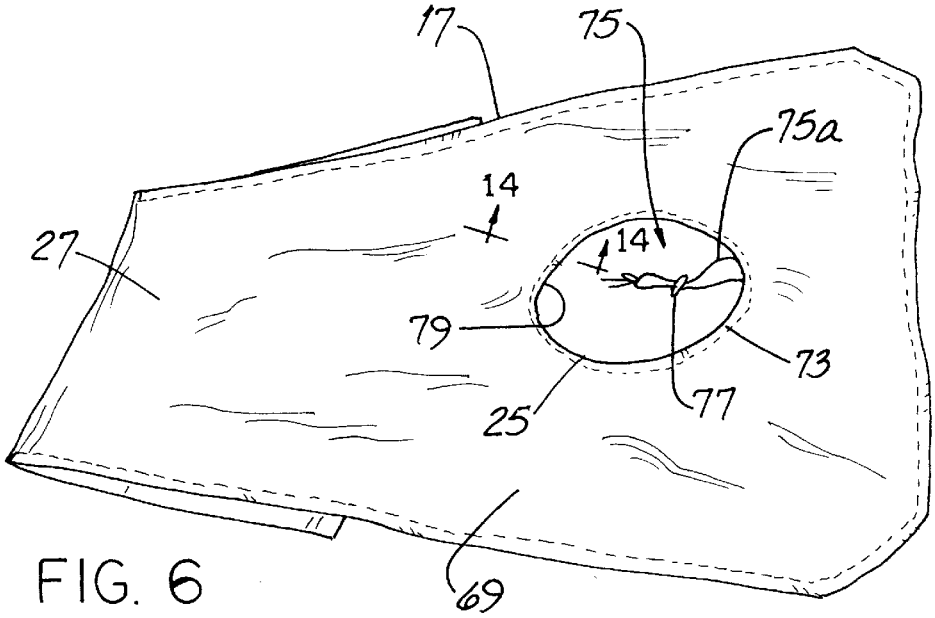
FIG. 6 is a perspective view of the liquid catch member of the apparatus. Hidden surfaces of parts are shown in dashed line.
Figure 7:
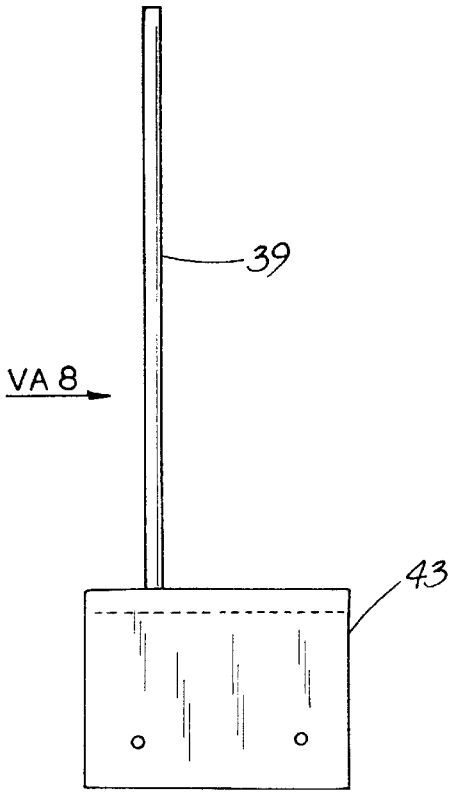
FIG. 7 is an elevation view of components of the attachment mechanism shown in FIGS. 2 and 3. Hidden surfaces of parts are shown in dashed line.
Figure 8:
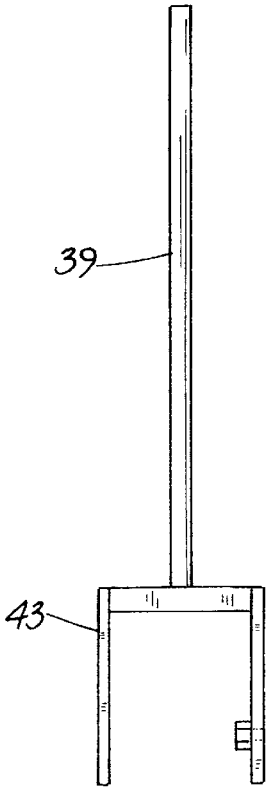
FIG. 8 is an elevation view of the components of FIG. 7 taken along the viewing axis VA8 thereof. Hidden surfaces of parts are shown in dashed line.

Referring particularly to FIGS. 3, 6, 11, 12, 13 and 14, the catch member 17 has an inward portion 69 defining the opening 25 which receives the upper part of a person's head 71 therethrough. The opening 25 is bounded by a tunnel 73 around it and a securing device 75 extends along the tunnel 73. In the embodiment of FIGS. 6 and 14, the securing device 75 is embodied as an inelastic drawstring 75*a* with a stop 77. When the opening 25 is fitted around the forehead and back portion of the head 71, the drawstring 75*a* is tugged so that the catch member 17 is snugly against the head 71 to prevent liquid leakage therethrough.

Referring to FIGS. 6, 12, 13 and 14, (FIG. 12 disclosing aspects common to the second embodiment described below and to both embodiments), the opening 25 includes an inward boundary surface 79 and a releasable strip 81 adheres to such boundary surface 79. The strip 81 is disposable, suitable for "one-time use," and is preferred for sanitary reasons. A highly preferred strip 81 is comprised of a thin, sponge-like resilient material 83 which absorbs water and which has an adhesive coating 85 placed against the boundary surface 79.

Most preferably, the catch member 17 including its apron portion 27 are made of thin, water-impermeable, highly-flexible fabric or the like. But whatever the material, it is most preferred that the catch member 17 be flaccid between the opening 25 and the support member 11. Using a catch member 17 which is flaccid, rather than reinforced, offers a number of advantages in ease of handling and ease of use.

Referring now to FIGS. 13 through 22, a second, more preferred embodiment of the apparatus 10 will now be described and like components are identified by the same numerals as those used in the description of the first embodiment. In the second embodiment, the support member 11*a* and integral plate 33*a* are molded of plastic. A separable joint 13*a* (of the pin-and-hole type) is formed to permit opening the support member 11*a* and threading the catch member 17*a* thereto.

The catch member 17*a* includes a plurality of securing straps 87 which fold around the support member 11*a* and affix to the underside of the catch member 17*a* inwardly of such support member 11*a*. Affixation is, for example, by a hook-and-eye type fastener of which VELCRO® is a well-known brand.

Figure 22:
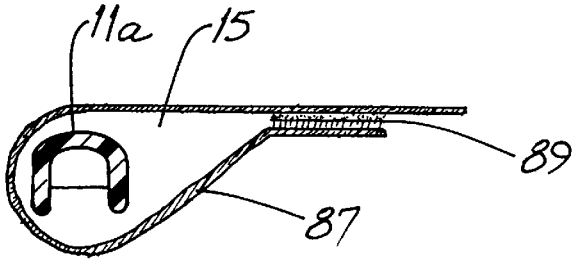
FIG. 22 is a section view generally like that of FIG. 10 and showing the catch member of FIG. 16 and the support member of FIG. 15. Parts are broken away.
Figure 11:
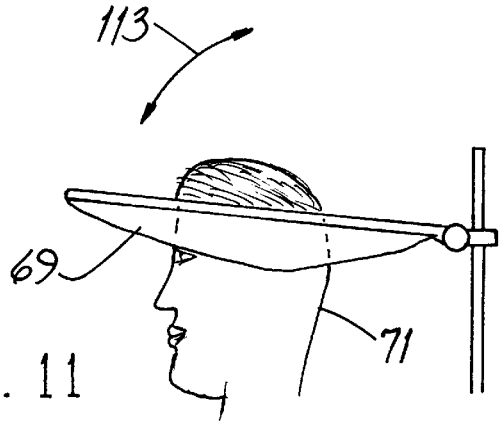
FIG. 11 is a representative elevation view showing the relationship of the apparatus to the head of a person whose hair is being washed. Parts are broken away.
Figure 13:
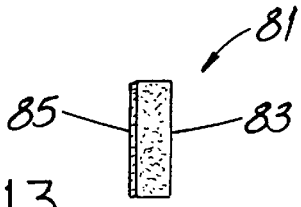
FIG. 13 is a section view of a resilient replaceable strip used with the apparatus of the embodiments.

As in the first embodiment, the support member 11*a* shown in FIG. 22 has a first cross-sectional area and the passage 15 has a second cross-sectional area greater than the first cross-sectional area. And as shown in FIG. 12, the tunnel 73 around the opening 25*a* has a cross-sectional area greater than that of the elastic band 75*b* so that the band 75*b* and the catch member 17*a* are relatively movable one to the other.

Figure 12:
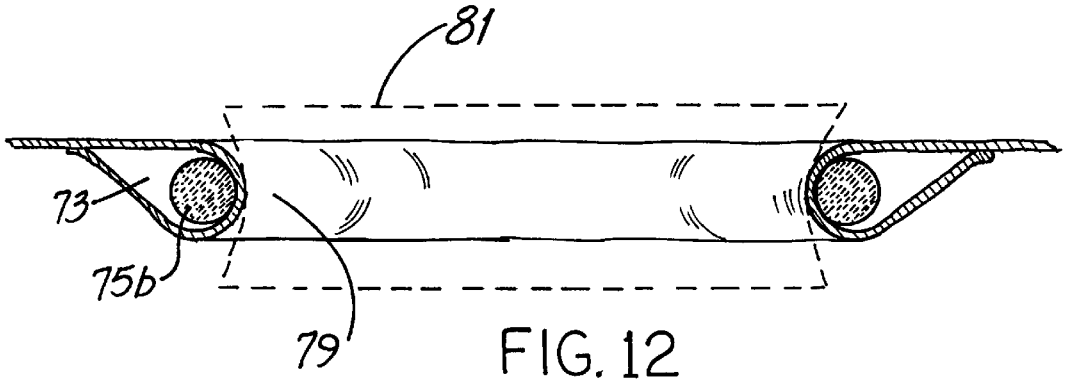
FIG. 12 is a section view taken along the viewing plane 12—12 of FIG. 16. Parts are broken away.
Figure 15:
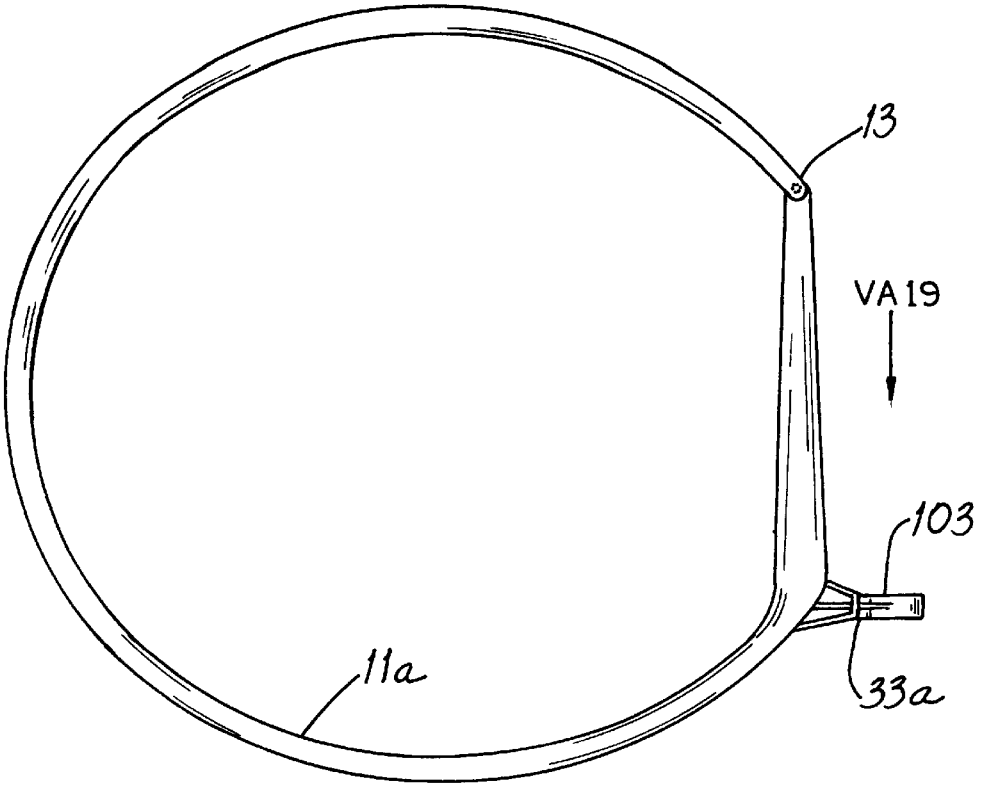
FIG. 15 is a top plan view of another embodiment of the support member of the apparatus. Hidden surfaces of parts are shown in dashed outline.
Figure 16:
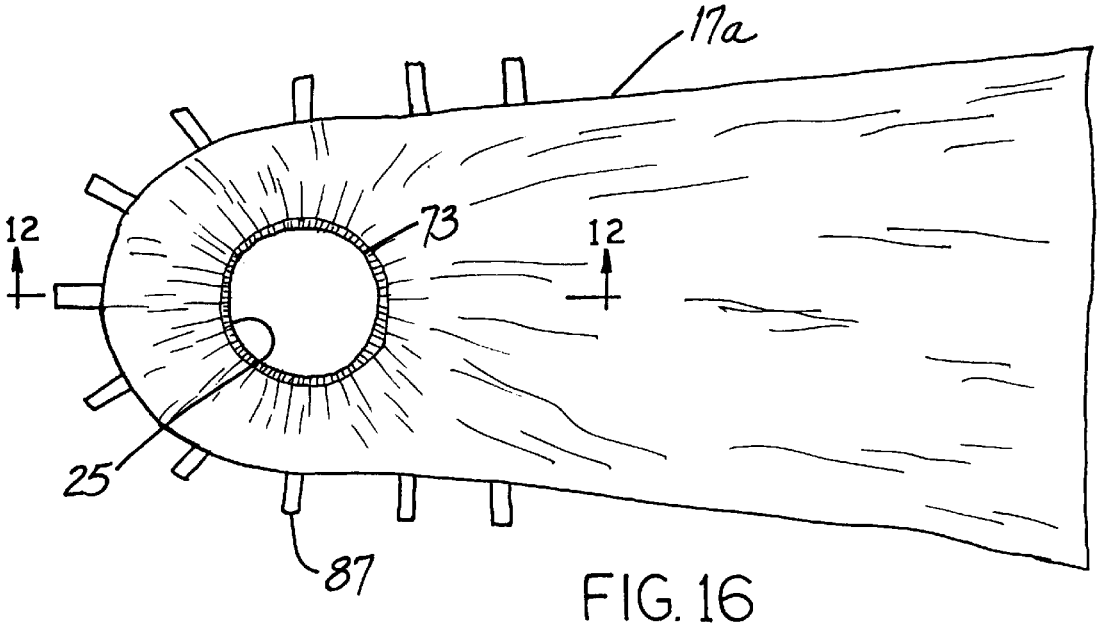
FIG. 16 is a top plan view of another embodiment of the liquid catch member of the apparatus.

In the embodiment shown in FIGS. 12 and 16, the securing device 75 is embodied as the elastic band 75*b*. The relative advantages of the drawstring 75*a* of FIG. 6 and the band of FIG. 12 are described above.

A bracket-like attachment mechanism 41 is provided to couple the apparatus 10 to a chair back or the like. The mechanism 41 depicted in FIGS. 17 and 18 includes an L-shaped bracket 91 having a number of slots 93 and 95 formed in the top panel 97 thereof. Separate securing straps 99 are received through one of the slots 93 and through one of the slots 95 to hold the bracket 91 to a chair back or the like.

The new apparatus 10 also includes a novel support rod 39 and related adjustment device 37. In the embodiment of FIGS. 15, 17, 18, 19 and 20, the support rod 39 has an H-shaped cross-section. Similarly, the tube 47 and bar 49 each include an H-shaped aperture 53*a*, 53*b*, respectively, which are sized to receive the rod 39 with sliding clearance. The threaded shank 55 is attached to the adjustment knob 59 and threads into an opening 101 in the bar 49. As with the adjustment device 37 of the first embodiment, tightening the knob 59 causes the bar 49 to move with respect to the tube 47 and clamp the rod 39. The H-shape is selected because it is a torque-transmitting shape which prevents the support member 11 from rotating laterally around the rod 39.

Figure 19:
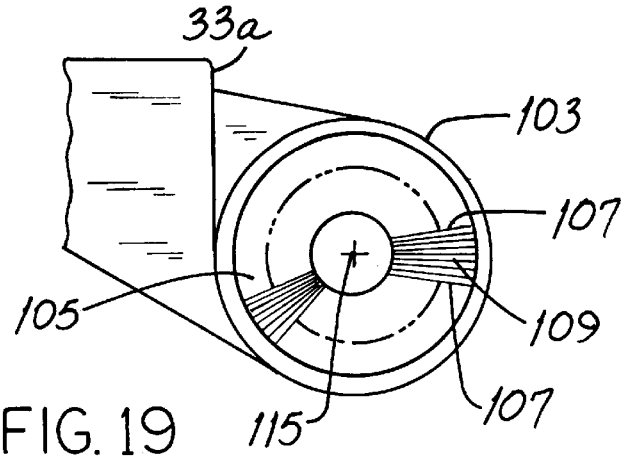
FIG. 19 is an elevation view, inverted and taken along viewing axis VA19, of a portion of the support member shown in FIG. 15.
Figure 21:
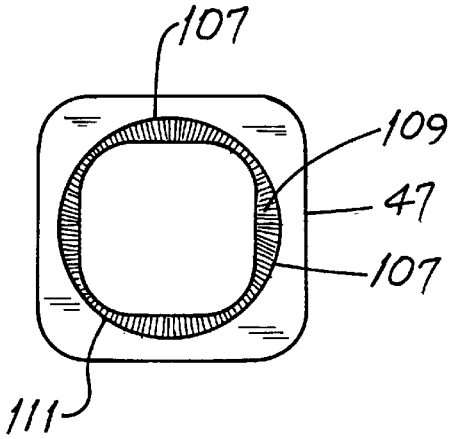
FIG. 21 is a view of a component of the mechanism shown in FIG. 20 taken along the viewing plane 21—21 thereof.

Referring to FIGS. 19, 20 and 21, the plate 33*a* of the second embodiment includes a circular boss 103 having a shallow pocket 105 with serration-like, radially-arranged alternating ridges 107 and grooves 109 therein. Similarly, the face 111 of the tube 47 has radially-arranged ridges 107 and grooves 109 thereon. When the apparatus is assembled, the face 111 and the pocket 105 bear against one another. The position of the support member 11*a* can be adjusted as represented by the arrow 113 in FIG. 11 and when the knob 59 is tightened, the ridges 107 and grooves 109 engage one another and fix the support member 11*a* with respect to an axis of rotation 115.

The invention also involves a new method for washing a person's hair 29 while retaining the neck of the person in a neutral position, i.e., substantially vertical position. The method includes providing an apparatus 10 having a flaccid liquid catch member 17*a* with an inward portion 69 defining an opening 25*a* for receiving a person's head 71 therethrough and having an inward boundary surface 79. A support member 11*a* is spaced outwardly from such portion 69.

A releasable strip 81 is applied to the boundary surface 79 and the inward portion 69 and releasable strip 81 are fitted about the head 71 of the person whose hair 29 is being washed. After hair washing is completed and the hair 29 "toweled" damp dry, the inward portion 69 is removed from the head 71. Then the releasable strip 81 is removed and discarded.

A more specific aspect of the method includes positioning the support member 11*a* at a location along the rod 39 and securing the adjustment device 37. The support member 11*a* is thereby positionally affixed with respect to the rod 39.

The adjective "flaccid" means limp to the degree that the subject of the adjective, the catch member, does not hold a shape in the absence of supplemental support. The term "torque-transmitting shape" means any shape capable of transmitting torque between two relatively-rotatable components. In general, virtually any random or regular geometric shape, e.g., hexagon, H-shaped or the like, except a circle is a torque-transmitting shape.

While the principles of this invention have been described in connection with specific embodiments, it should be understood clearly that these descriptions are made only by way of example and are not intended to limit the scope of the invention.

What is claimed:

1. In an apparatus for use when washing hair and including a liquid catch member having an inward portion defining an opening for receiving a person's head therethrough; a support member spaced outwardly from such portion; and an attachment mechanism having a support rod extending therefrom, the improved wherein:

the support member comprises a hoop having a first cross-sectional area and a separable joint, the hoop separatable between a first open position and a second closed position wherein the hoop forms a closed loop, the support member further including an adjustment device attached thereto, the support rod extending through an aperture in the adjustment device, wherein the support rod and the aperture are formed to a torque-transmitting shape; and the catch member is around the support member and defines a passage having a second cross-sectional area greater than the first cross-sectional area, thereby permitting the catch member and the support member to be readily moved with respect to one another.

2. The apparatus of claim 1 wherein:

the catch member is flaccid between the portion and the hoop.

3. The apparatus of claim 1 wherein:

the passage has first and second ends; and the catch member includes an insertion notch between the ends of the passage, thereby permitting the catch member to be readily removed from and mounted to the hoop.

4. The apparatus of claim 3 wherein:

the catch member includes an apron portion extending away from the opening; and the insertion notch is between the opening and the apron portion.

5. The apparatus of claim 1 wherein:

the opening includes a tunnel therearound; and a securing device extends along the tunnel.

6. The apparatus of claim 5 wherein the securing device is a drawstring.

7. The apparatus of claims 5 wherein the securing device is an elastic band.

8. The apparatus of claim 1 wherein:

the opening includes an inward boundary surface; and a releasable strip adheres to the boundary surface.

9. A method for washing a person's hair while retaining the neck of the person in a neutral position including the steps of:

providing an apparatus having a flaccid liquid catch member with an inward portion defining an opening for receiving a person's head therethrough and a support member spaced outwardly from such portion, such opening having an inward boundary surface wherein;

the apparatus further including an attachment mechanism having a support rod extending therefrom;

the support member includes an adjustment device attached thereto;

the rod extends through an aperture in the device; and the rod and the aperture are formed to a torque-transmitting shape;

positioning the support member at a location along the rod;

securing the adjustment device, thereby affixing the support member with respect to the rod;

applying a releasable strip to the boundary surface;

fitting the inward portion and releasable strip about the head;

washing the hair;

removing the inward portion from the head; and discarding the releasable strip.

* * * * *